US011433293B1

(12) United States Patent
Hickey, Jr.

(10) Patent No.: US 11,433,293 B1
(45) Date of Patent: Sep. 6, 2022

(54) ROLLER BLADE ICE WHEEL ASSEMBLY

(71) Applicant: John J. Hickey, Jr., Pembroke, MA (US)

(72) Inventor: John J. Hickey, Jr., Pembroke, MA (US)

( * ) Notice: Subject to any disclaimer, the term of this patent is extended or adjusted under 35 U.S.C. 154(b) by 0 days.

(21) Appl. No.: 17/324,708

(22) Filed: May 19, 2021

(51) Int. Cl.
*A63C 1/30* (2006.01)
*A63C 17/18* (2006.01)
*A63C 17/22* (2006.01)
*A63C 17/14* (2006.01)

(52) U.S. Cl.
CPC ..... *A63C 17/18* (2013.01); *A63C 17/1436* (2013.01); *A63C 17/226* (2013.01); *A63C 2017/1481* (2013.01); *A63C 2203/42* (2013.01)

(58) Field of Classification Search
CPC ... A63C 17/18; A63C 17/1436; A63C 17/226; A63C 2203/42
See application file for complete search history.

(56) References Cited

U.S. PATENT DOCUMENTS 3,689,091 A * 9/1972 Nagin ..... A63C 17/18 280/11.12
4,805,934 A * 2/1989 Mullenax ..... A63C 17/18 280/13
5,259,632 A * 11/1993 Mahoney ..... A63C 17/18 280/7.14
5,411,320 A * 5/1995 Aiderman ..... A63C 17/18 301/5.308
5,524,912 A * 6/1996 Laub ..... A63C 5/025 280/11.224
5,901,970 A 5/1999 Henshaw
5,906,380 A 5/1999 Searby
5,915,702 A * 6/1999 Kirschling ..... A63C 17/22 280/11.231
5,971,405 A 10/1999 Edauw
D417,713 S 12/1999 Priester
6,032,962 A * 3/2000 DiGregorio ..... A63C 1/306 280/8
6,039,328 A 3/2000 Pawlowski
6,182,980 B1 * 2/2001 Smith ..... A63C 1/306 280/11.231
6,322,154 B1 11/2001 Alderman
6,382,638 B1 * 5/2002 Lee ..... A43B 5/1633 280/11.3
D475,109 S 5/2003 Washburn
6,578,930 B1 * 6/2003 Aiderman ..... A63C 1/00 301/5.303
7,318,591 B2 1/2008 Landry
(Continued)

*Primary Examiner* — Brian L Swenson

(57) ABSTRACT

A roller blade ice wheel assembly for using roller blades on ice includes a plurality of blade wheel apparatuses each comprising a wheel body having a central wheel aperture, a pair of wheel sidewalls, and a wheel edge. The wheel edge is less than 0.5 cm. At least one bearing is coupled to the wheel body. The bearing receives an axle of a roller blade through a bearing aperture and the wheel aperture. Each of a plurality of spacers has a central spacer aperture to receive the axle of the roller blade. The plurality of spacers is positioned on both sides of the bearing to occupy space up to a wheel frame of the roller blade. The width of the blade wheel apparatus is dimensioned to equal the width of a wheel of the roller blade that is being replaced.

9 Claims, 8 Drawing Sheets

(56) References Cited

U.S. PATENT DOCUMENTS

| | | | | |
|---|---|---|---|---|
| 2008/0290619 | A1* | 11/2008 | Leo | A63C 17/18<br>280/11.18 |
| 2009/0085313 | A1* | 4/2009 | Landry | A63C 17/18<br>280/11.18 |
| 2010/0225100 | A1 | 9/2010 | DePetri | |

* cited by examiner

ROLLER BLADE ICE WHEEL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to roller blade ice adaptor devices and more particularly pertains to a new roller blade ice adaptor device for using roller blades on ice. The present device includes a plurality of annular blades, roller bearings, and spacers to attach to a standard wheel frame of a roller blade.

(2) Description of Related Art Including Information Disclosed Under 37 CFR 1.97 and 1.98

The prior art relates to roller blade ice adaptor devices. Many known devices add a skating blade to the boot rather than ice wheels. Of the devices that offer ice wheels, many require a replacement of the wheel frame in order to accommodate the thinner blade wheels. Known devices also lack a toe rack that can be added to the toe of the boot.

BRIEF SUMMARY OF THE INVENTION

An embodiment of the disclosure meets the needs presented above by generally comprising a plurality of blade wheel apparatuses each comprising a wheel body having a central wheel aperture, a pair of wheel sidewalls, and a wheel edge. The wheel edge is less than 0.5 cm. At least one bearing is coupled to the wheel body. The bearing is configured to receive an axle of a roller blade through a bearing aperture and the wheel aperture. Each of a plurality of spacers has a central spacer aperture configured to receive the axle of the roller blade. The plurality of spacers is positioned on both sides of the bearing to occupy space up to a wheel frame of the roller blade. The width of the blade wheel apparatus is dimensioned to equal the width of a wheel of the roller blade that is being replaced.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
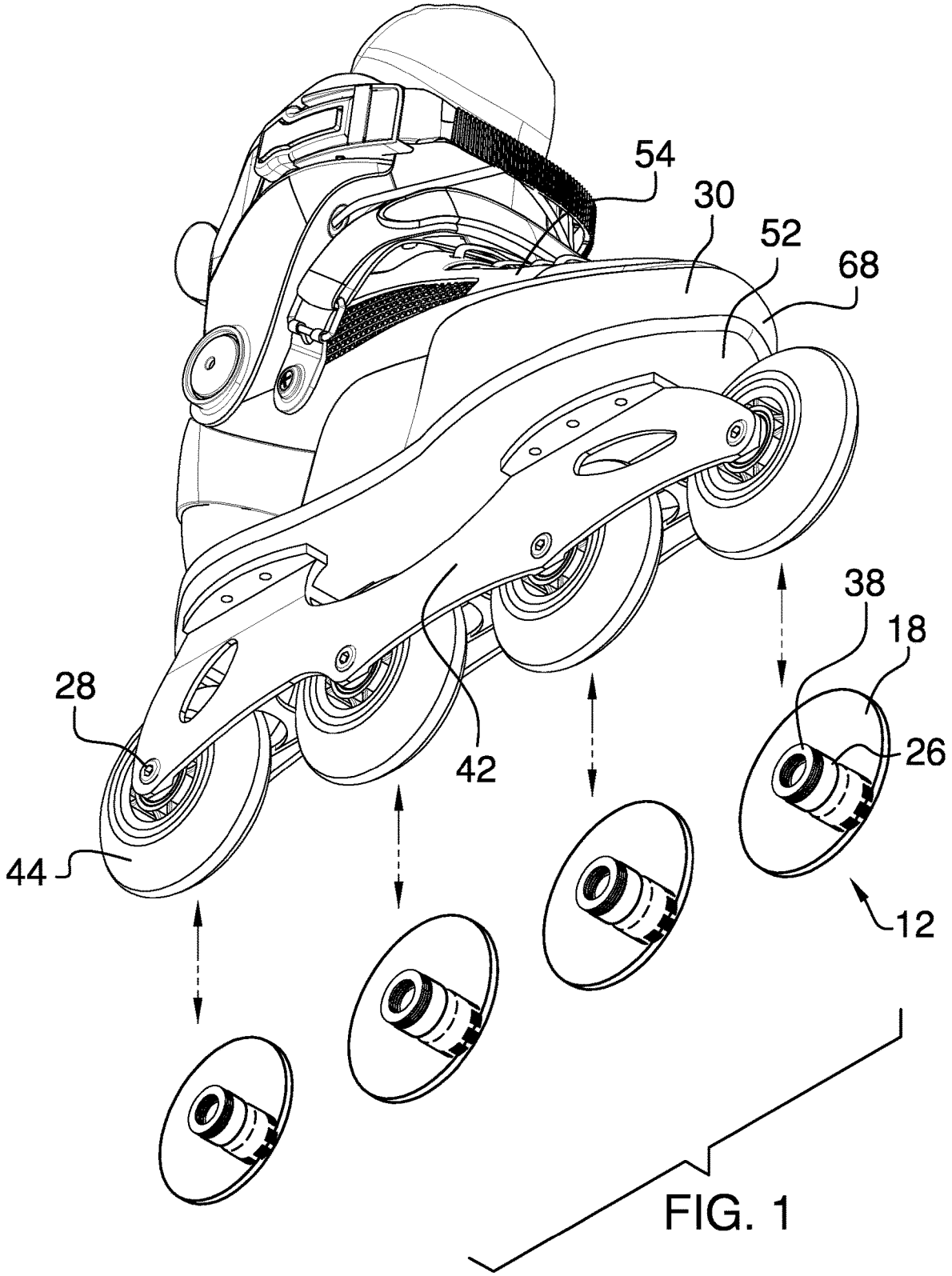
FIG. 1 is an isometric view of a roller blade ice wheel assembly according to an embodiment of the disclosure.

With reference now to the drawings, and in particular to FIGS. 1 through 8 thereof, a new roller blade ice adaptor device embodying the principles and concepts of an embodiment of the disclosure and generally designated by the reference numeral 10 will be described.

As best illustrated in FIGS. 1 through 8, the roller blade ice wheel assembly 10 generally comprises a plurality of blade wheel apparatuses 12, a toe rake apparatus 14, and a toe stopper apparatus 16. Each blade wheel apparatus 12 comprises a wheel body 18 having a central wheel aperture 20, a pair of wheel sidewalls 22, and a wheel edge 24. The wheel edge 24 is less than 0.5 cm.

At least one bearing 26 is coupled to the wheel body 18. The bearing 26 is configured to receive an axle 28 of a roller blade 30 through a bearing aperture 32 and the wheel aperture 20. The axle 28 may include a threaded axle sleeve 34 and an axle screw 36 selectively engageable with the threaded axle sleeve 34. The bearing 26 may be coupled within the central wheel aperture 20 or may alternatively be two bearings 26 positioned on the pair of wheel sidewalls 22.

Figure 2:
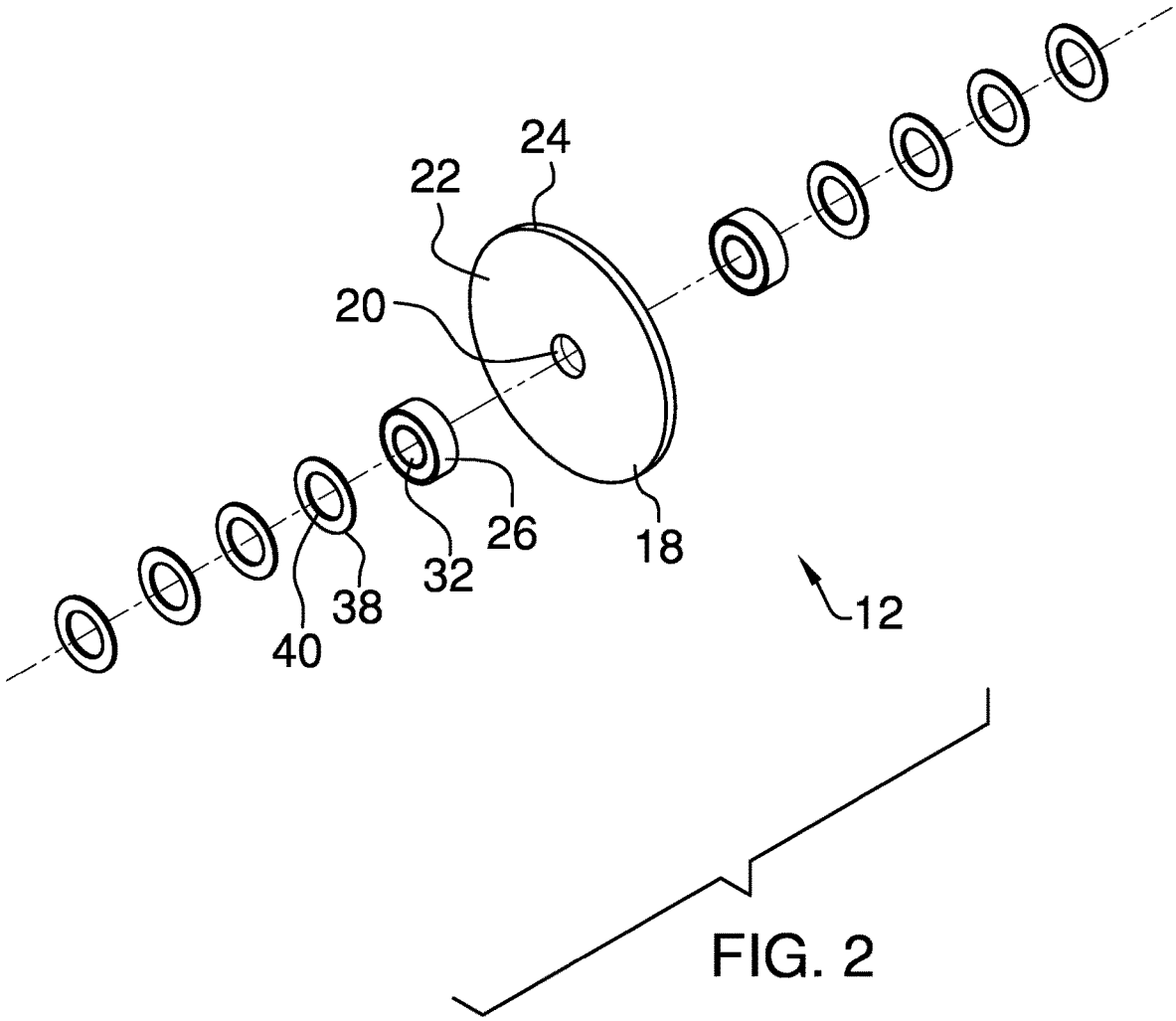
FIG. 2 is an isometric view of an embodiment of the disclosure.
Figure 3:
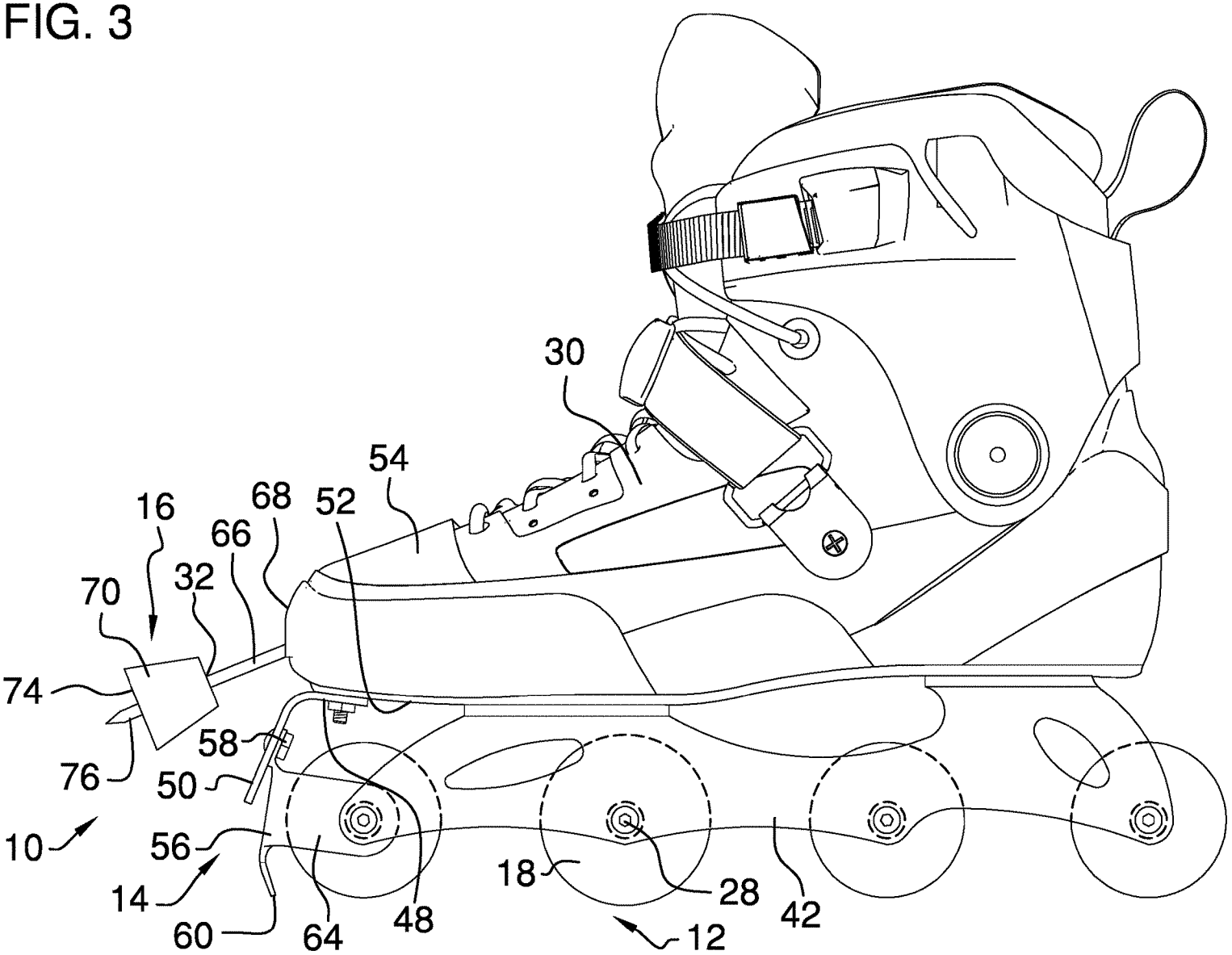
FIG. 3 is a side elevation view of an embodiment of the disclosure.
Figure 4:
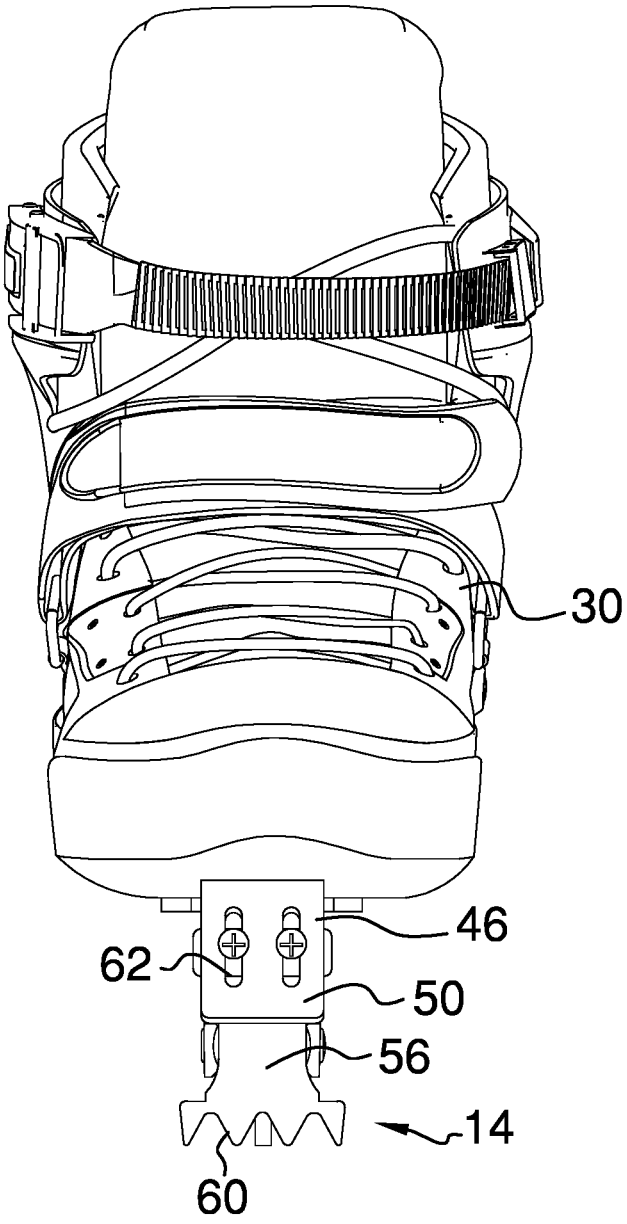
FIG. 4 is a front elevation view of an embodiment of the disclosure.
Figure 5:
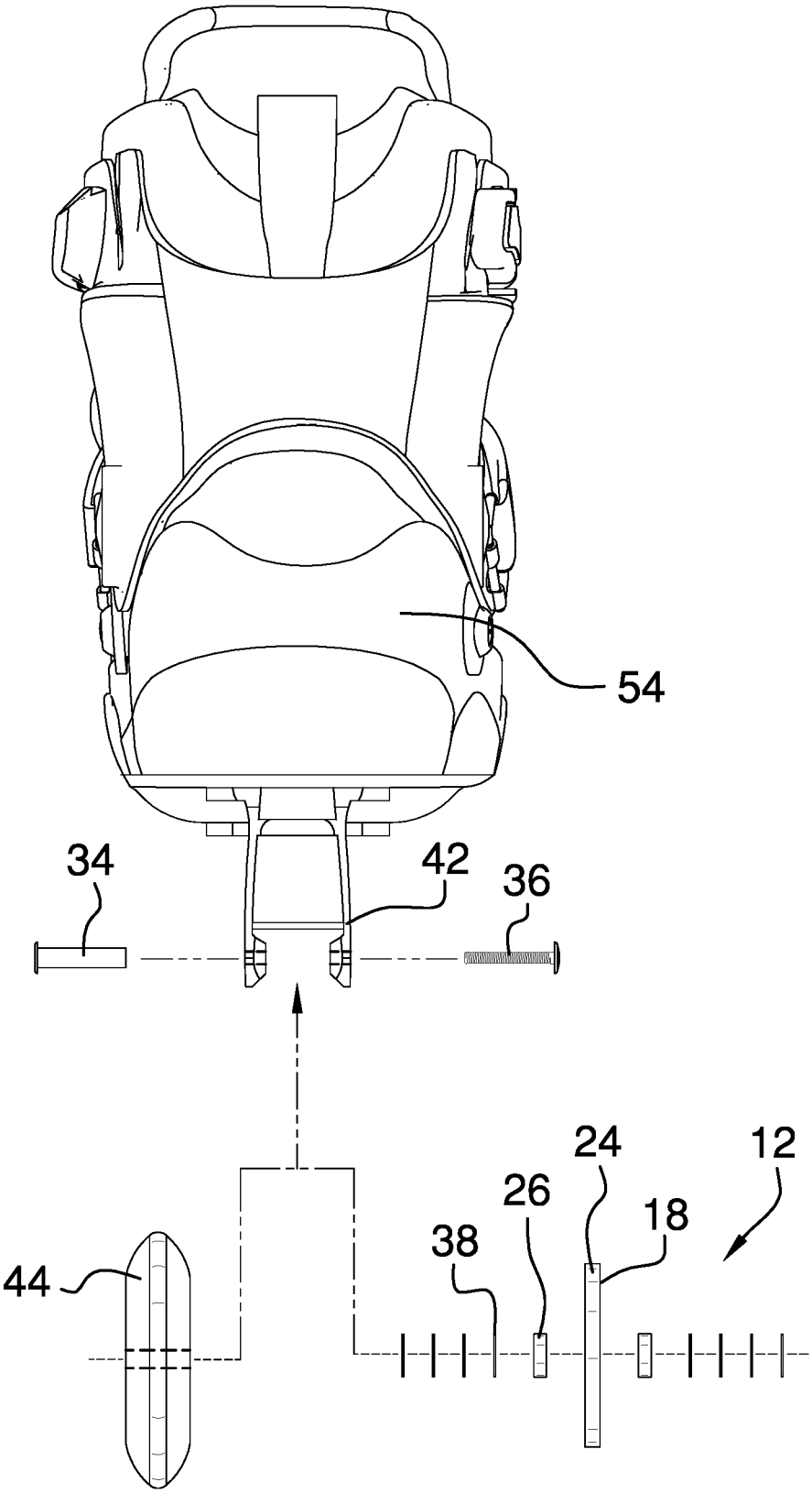
FIG. 5 is a rear elevation view of an embodiment of the disclosure.
Figure 6:
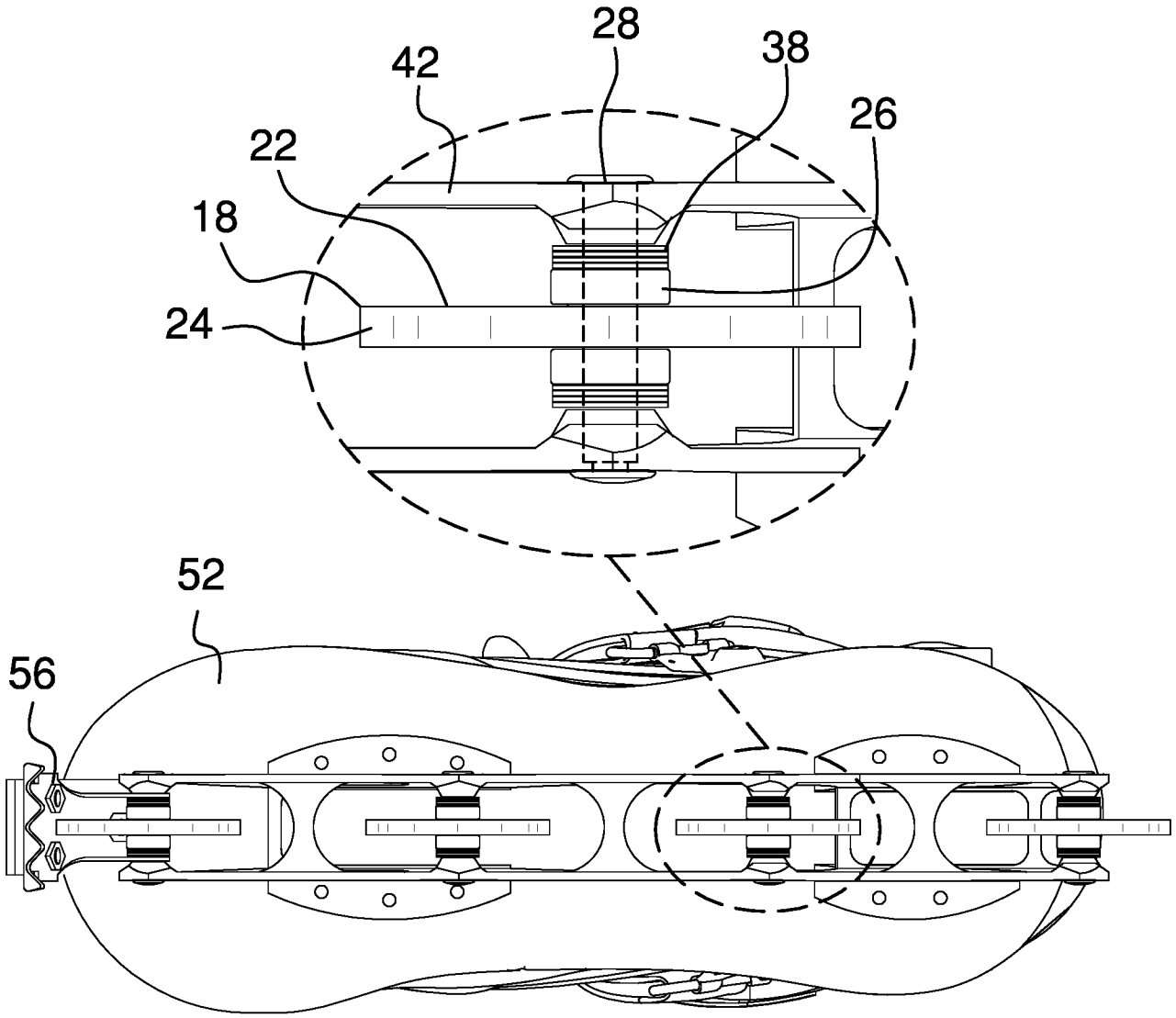
FIG. 6 is a bottom plan view of an embodiment of the disclosure.
Figure 7:
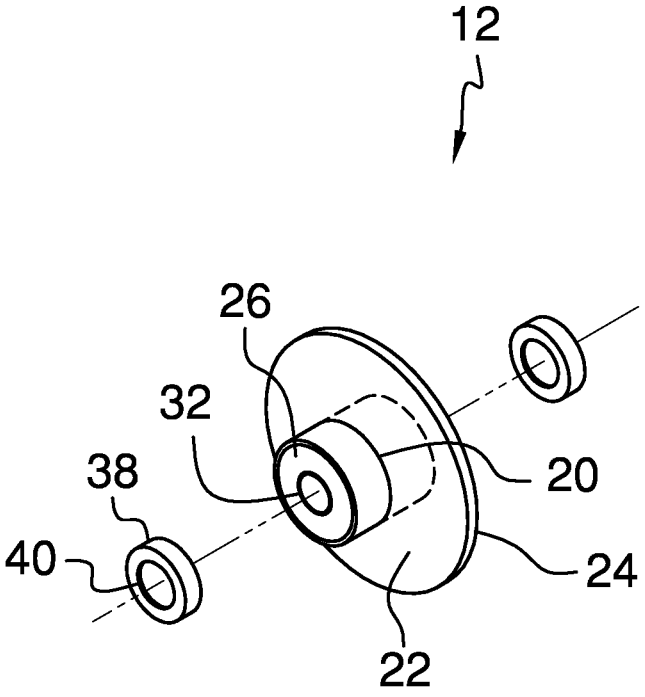
FIG. 7 is an isometric view of an embodiment of the disclosure.
Figure 8:
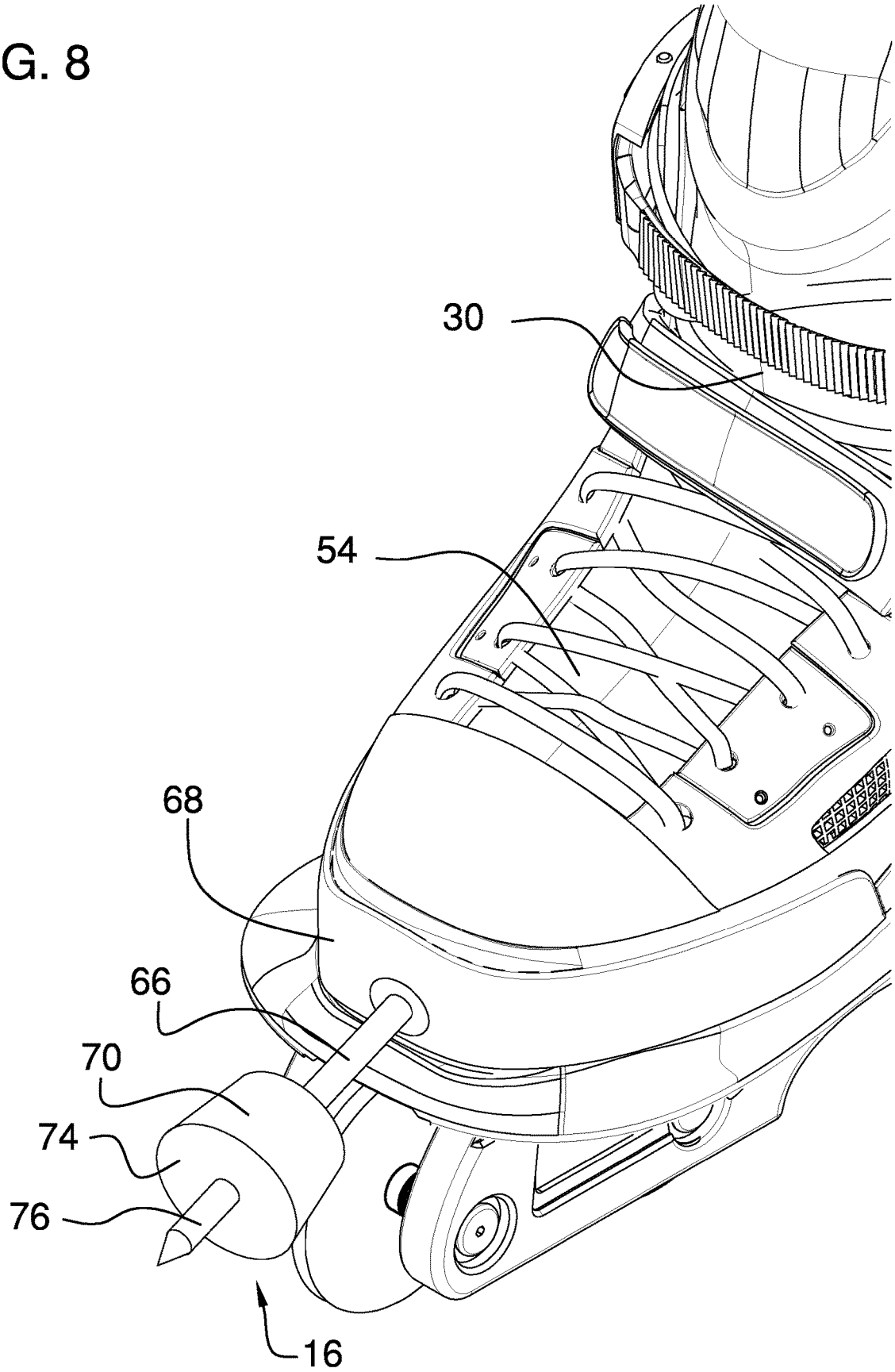
FIG. 8 is an isometric view of an embodiment of the disclosure.

Each of a plurality of spacers 38 has a central spacer aperture 40 configured to receive the axle 28 of the roller blade. The plurality of spacers 38 is positioned on both sides of the bearing 26 to occupy space up to a wheel frame 42 of the roller blade. The width of the blade wheel apparatus 10 is dimensioned to equal the width of a wheel 44 of the roller blade that is being replaced. The plurality of spacers 38 may thus be numerous thinner spacers 38 as shown in FIG. 2 or two wider spacers 38 as shown in FIG. 7.

The toe rake apparatus 14 comprises a rake bracket 46 having a bracket boot portion 48 and a bracket extension portion 50. The bracket boot portion 48 is configured to be coupled to a boot underside 52 of a boot 54 of the roller blade. The bracket boot portion 48 and the bracket extension portion 50 may form an angle between 90° and 135°. A rake body 56 has a rake attachment portion 58 coupled to the bracket extension portion 50. A rake distal edge 60 of the rake body 56 is serrated to grip the ice when desired. The rake attachment portion 58 may be adjustably coupled to a pair of attachment slots 62 extending through the bracket extension portion 50. The rake body 56 may have a pair of rake ears 64 extending between the rake attachment portion 58 and the rake distal edge 60. The pair of rake ears 64 is configured to be coupled to the wheel frame 42 of the roller blade for structural support.

The toe stopper apparatus 16 comprises a stopper shaft 66. The stopper shaft 66 is configured to be selectively engageable with a toe 68 of the boot of the roller blade. A stopper body 70 is coupled to the stopper shaft 66. The stopper body 70 is selectively engageable with a shaft distal end 72 of the stopper shaft. The stopper body 70 may be a truncated conical shape and has a circular stopper distal face 74. A stopper spike 76 may be coupled to the stopper body 70 and extends from the stopper distal face 74 to engage the ice to allow the user to do spins and tricks.

In use, the plurality of blade wheel apparatuses 12 is engaged with the roller blade 30 for use on ice. The toe rake apparatus 14 and the toe stopper apparatus 16 may also be selectively added to the boot 54 as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A roller blade ice wheel assembly comprising:

a plurality of blade wheel apparatuses each comprising:

a wheel body having a central wheel aperture, a pair of wheel sidewalk, and a wheel edge, the wheel edge being less than 0.5 cm;

at least one bearing coupled to the wheel body, the bearing being configured to receive an axle of a roller blade through a bearing aperture and the wheel aperture;

a plurality of spacers, each spacer having a central spacer aperture configured to receive the axle of the roller blade, the plurality of spacers being positioned on both sides of the bearing to occupy space up to a wheel frame of the roller blade, the width of the blade wheel apparatus being dimensioned to equal the width of a wheel of the roller blade that is being replaced; and a toe rake apparatus comprising:

a rake bracket having a bracket boot portion and a bracket extension portion, the bracket boot portion being configured to be coupled to a boot underside of a boot of the roller blade; and a rake body coupled to the rake bracket, the rake body having a rake attachment portion coupled to the bracket extension portion, a rake distal edge of the rake body being serrated.

2. The roller blade ice wheel assembly of claim 1 further comprising the central wheel aperture being dimensioned to receive the axle of the roller blade; a pair of bearings being positioned on each side of the wheel body.

3. The roller blade ice wheel assembly of claim 1 further comprising the bearing being coupled within the central wheel aperture.

4. The roller blade ice wheel assembly of claim 1 further comprising the axle including a threaded axle sleeve and an axle screw selectively engageable with the threaded axle sleeve.

5. The roller blade ice wheel assembly of claim further comprising the bracket boot portion and the bracket extension portion forming an angle between 90° and 135°.

6. The roller blade ice wheel assembly of claim 1 further comprising the rake attachment portion being adjustably coupled to a pair of attachment slots extending through the bracket extension portion.

7. The roller blade ice wheel assembly of claim 1 thither comprising the rake body having a pair of rake ears extending between the rake attachment portion and the rake distal edge, the pair of rake ears being configured to be coupled to the wheel frame of the roller blade.

8. A roller blade ice wheel assembly comprising:

a plurality of blade wheel apparatuses each comprising:

a wheel body having a central wheel aperture, a pair of wheel sidewalk, and a wheel edge, the wheel edge being less than 0.5 cm;

at least one bearing coupled to the wheel body, the bearing being configured to receive an axle of a roller blade through a bearing aperture and the wheel aperture;

a plurality of spacers, each spacer having a central spacer aperture configured to receive the axle of the roller blade, the plurality of spacers being positioned on both sides of the bearing to occupy space up to a wheel frame of the roller blade, the width of the blade wheel apparatus being dimensioned to equal the width of a wheel of the roller blade that is being replaced; and a toe stopper apparatus comprising:

a stopper shaft, the stopper shaft being configured to be selectively engageable with a toe of a boot of the roller blade; and a stopper body coupled to the stopper shaft, the stopper body being selectively engageable with a shaft distal end of the stopper shaft, the stopper body having a stopper distal face; and a stopper spike coupled to the stopper body, the stopper spike extending from the stopper distal face.

9. A roller blade ice wheel assembly comprising:

a plurality of blade wheel apparatuses each comprising:

a wheel body having a central wheel aperture, a pair of wheel sidewalk, and a wheel edge, the wheel edge being less than 0.5 cm;

at least one bearing coupled to the wheel body, the bearing being configured to receive an axle of a roller blade through a bearing aperture and the wheel aperture, the axle including a threaded axle sleeve and an axle screw selectively engageable with the threaded axle sleeve, the bearing being coupled within the central wheel aperture;

a plurality of spacers, each spacer having a central spacer aperture configured to receive the axle of the roller blade, the plurality of spacers being positioned on both sides of the bearing to occupy space up to a wheel frame of the roller blade, the width of the blade wheel apparatus being dimensioned to equal the width of a wheel of the roller blade that is being replaced;

a toe rake apparatus comprising:

a rake bracket having a bracket boot portion and a bracket extension portion, the bracket boot portion being configured to be coupled to a boot underside of a boot of the roller blade, the bracket boot portion and the bracket extension portion forming an angle between 90° and 135°; and a rake body coupled to the rake bracket, the rake body having a rake attachment portion coupled to the bracket extension portion, a rake distal edge of the rake body being serrated, the rake attachment portion being adjustably coupled to a pair of attachment slots extending through the bracket extension portion, the rake body having a pair of rake ears extending between the rake attachment portion and the rake distal edge, the pair of rake ears being configured to be coupled to the wheel frame of the roller blade; and a toe stopper apparatus comprising:

a stopper shaft, the stopper shaft being configured to be selectively engageable with a toe of boot of the roller blade; and a stopper body coupled to the stopper shaft, the stopper body being selectively engageable with a shaft distal end of the stopper shaft, the stopper body having a stopper distal face; and a stopper spike coupled to the stopper body, the stopper spike extending from the stopper distal face.

* * * * *